US005448784A

United States Patent [19]

Smiley

[11] Patent Number: 5,448,784

[45] Date of Patent: Sep. 12, 1995

[54] URINAL ASSEMBLY AND ELECTRICALLY ACTUATED VALVE FOR SAME

[76] Inventor: Everett J. Smiley, 1326 Sandtrap Dr., SW., Fort Myers, Fla. 33919

[21] Appl. No.: 216,056

[22] Filed: Mar. 22, 1994

Related U.S. Application Data

[63] Continuation-in-part of Ser. No. 994,354, Dec. 21, 1992, Pat. No. 5,301,374, which is a continuation-in-part of Ser. No. 612,920, Nov. 13, 1990, abandoned.

[51] Int. Cl.[6] ..... E03D 9/00

[52] U.S. Cl. ..... 4/341; 251/129.15; 4/DIG. 3

[58] Field of Search ..... 4/340, 341, 342, 406, 4/410, 420.2, 420.3, 445, 446, DIG. 3; 251/129.15, 129.22

[56] References Cited

U.S. PATENT DOCUMENTS

| | | | |
|---|---|---|---|
| 2,957,180 | 10/1960 | McMullen | 4/420.2 |
| 3,336,602 | 8/1967 | Kubit | 4/341 |
| 3,928,874 | 12/1975 | Albertson | 4/342 |
| 4,137,579 | 2/1979 | Soler | 4/144.3 X |
| 4,771,982 | 9/1988 | Bodine et al. | 251/129.15 X |
| 5,299,328 | 4/1994 | Walega | 4/342 X |

*Primary Examiner*—Charles E. Phillips
*Attorney, Agent, or Firm*—William E. Noonan

[57] ABSTRACT

A urinal assembly is disclosed for use in a toilet apparatus having a toilet bowl, a tank communicably connected to and located generally above the toilet bowl and a supply conduit for delivering water under service line pressure to the tank. The toilet assembly comprises a urinal bowl for mounting within the toilet bowl. An inlet conduit is interconnected between the supply conduit and the bowl. A valve is interconnected to the inlet conduit for controlling the flow of water under service line pressure therethrough. An electrical solenoid is employed to selectively open and close the valve to introduce water to the urinal bowl through the inlet conduit. A discharge conduit is provided for discharging water from the urinal bowl when the bowl is flushed.

3 Claims, 1 Drawing Sheet

URINAL ASSEMBLY AND ELECTRICALLY ACTUATED VALVE FOR SAME

RELATED APPLICATIONS

This application is a continuation in part of Ser. No. 994,354, filed Dec. 21, 1992, now U.S. Pat. No. 5,301,374, which is a continuation in part of Ser. No. 612,920 filed Nov. 13, 1990, now abandoned.

FIELD OF THE INVENTION

This invention relates to a urinal assembly for use in combination with a standard toilet and, in particular, to a water saving urinal assembly that is flushed through the use of an electrically actuated valve mechanism.

BACKGROUND OF THE INVENTION

Conventional water closets waste billions of gallons of water annually. Each time a typical toilet is flushed, at least several gallons of water are used. Such an amount is clearly excessive, particularly when only liquid waste is being flushed.

To reduce water usage, a number of toilets have been developed that employ partitioned sections for accommodating liquid and solid waste. One known toilet, U.S. Pat. No. 3,336,602, uses a separate urinal bowl that is flushed by water under a gravity pressure head in the reservoir tank of the toilet. That apparatus requires the water in the tank to remain at a typically high level in order for the urinal flush system to operate. The system will not operate if the user desires to significantly reduce the amount of water used to flush the main bowl. Additionally, this system requires a pair of separate flush handles and cannot be retrofit onto existing toilets.

The above problems are largely overcome by my co-pending application Ser. No. 994,354, which relates to a urinal assembly that is flushed using incoming service line pressure. Although that invention teaches a number of advantages, it also requires the use of a relatively intricate mechanical valve mechanism to interconnect the urinal assembly with the source of incoming service line water. I have recognized that the need exists for an improved, simpler valve mechanism that operates electrically. I have further recognized that the operation of my urinal assembly will be facilitated considerably if the valve interconnecting the incoming service line and the urinal assembly is located outside of the toilet tank.

SUMMARY OF INVENTION

It is therefore an object of this invention to provide a simpler, improved, electrically operated valve mechanism for introducing water under service line pressure to a urinal assembly integrated with and operable independently of a standard toilet.

It is a further object of this invention to provide a urinal assembly in combination with a toilet that can be flushed independently of the toilet thereby resulting in considerable conservation of water.

It is a further object of this invention to provide a valve mechanism for introducing water into a urinal assembly of a toilet, which valve is located entirely outside of the toilet tank.

This invention results from the realization that an improved, simpler valve for providing water under service line pressure to a urinal assembly integrated into a conventional toilet may be accomplished by employing an electrically activated valve in an inlet conduit that is connected directly to the incoming service line beneath the toilet tank. As a result, the valve is located outside of the toilet tank and installation, servicing and operation are facilitated greatly.

This invention features a urinal assembly for use in a toilet apparatus having a toilet bowl, a tank communicably connected to and located generally above the bowl, a supply conduit for delivering water under service line pressure to the tank and a sewer line connected to the toilet bowl for discharging the contents of the bowl when the bowl is flushed. The urinal assembly includes a urinal bowl for mounting within the toilet bowl. There is an inlet conduit interconnected between the supply conduit and the bowl. A valve is operably interconnected to the inlet conduit for controlling the flow of water under service line pressure therethrough. There are electrically activated drive means for selectively opening the valve to introduce water under service line pressure into the bowl to flush the bowl. The drive means also selectively close the valve to block the flow of water therethrough. A discharge conduit is interconnected between the urinal bowl and the sewer line for discharging the contents of the urinal bowl when the urinal bowl is flushed.

In a preferred embodiment, the means for driving include a solenoid. The inlet conduit may include first and second segments that are interconnected by the valve. The valve may include a valve housing, a valve element movably mounted in the valve housing and having formed therethrough a channel that is communicably alignable with the first and second segments of the inlet conduit. A spring or other means are provided for biasing the valve element into a closed condition within the housing such that the channel is not aligned with the first and second segments. The drive means selectively urge the valve element against the spring means to align the channel with the first and second segments and open the valve.

Preferably, timer means are provided for directing the drive means to hold the valve open for a predetermined period. Such timer means may include a solid state timer.

The valve and drive means may be located beneath the toilet tank. Bracket means may be provided for releasably mounting the urinal bowl to the main toilet bowl.

DETAILED DESCRIPTION OF PREFERRED EMBODIMENTS

Figure 2:
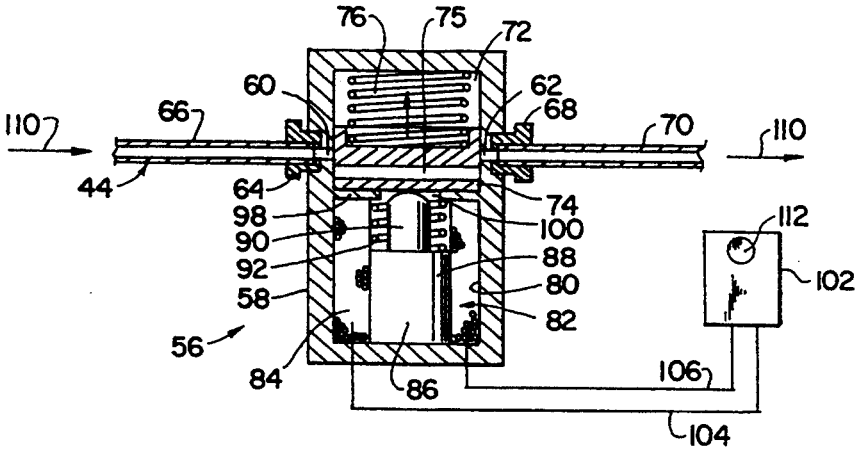
Figure 1:
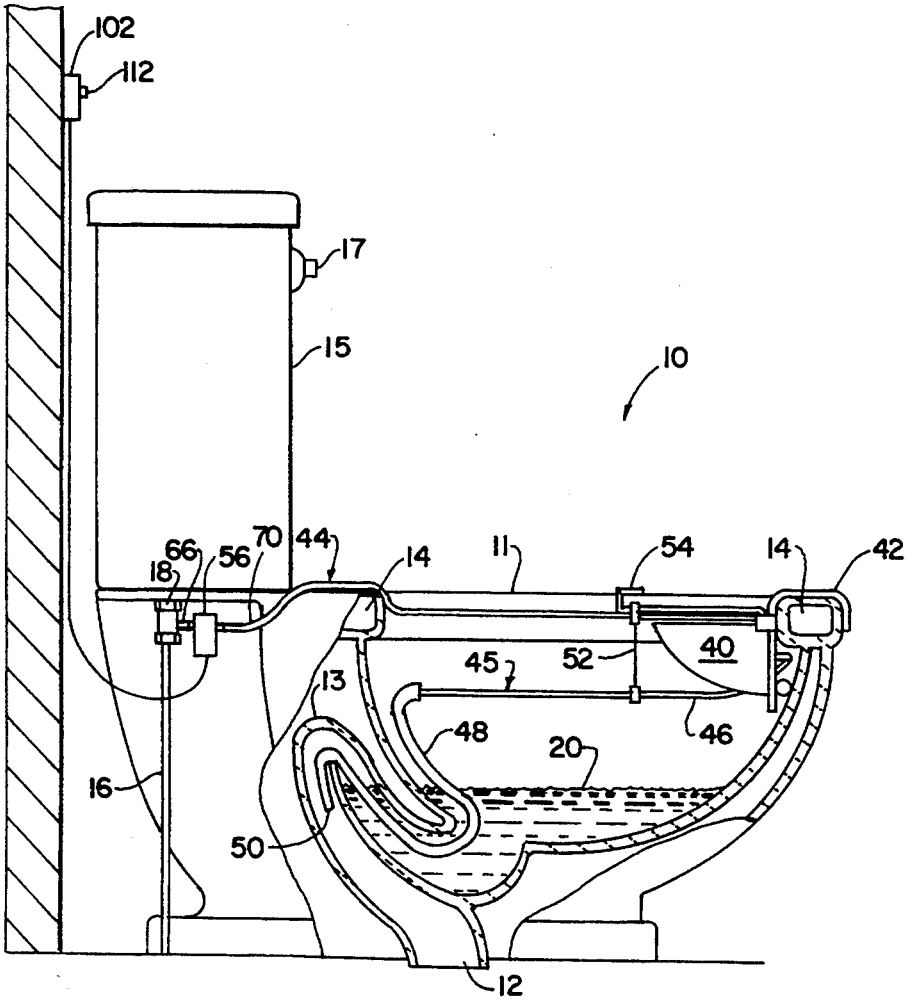

Other objects, features and advantages will occur from the following description of preferred embodiments and the accompanying drawings, in which:

FIG. 1 is an elevational, side view, partly in cross section, of a toilet including the urinal assembly and valve of this invention; and FIG. 2 is a partly cross sectional, partly schematic view of the valve mechanism and electrically activated drive means.

There is shown in FIG. 1 a toilet apparatus 10 employing the urinal assembly of this invention. Apparatus 10 includes a main toilet bowl 11 that is connected in a known manner to a discharge sewer line 12 through a gooseneck trap 13. A channel 14 is formed about the rim of toilet bowl 11. Channel 14 includes a plurality of conventional holes, not shown, that deliver water from a conventional reservoir tank 15 each time the main bowl 11 is flushed by depressing handle 17.

A pressurized water service line 16 is interconnected to the bottom of tank 15 in a conventional manner through a fitting 18. Water service line 16 provides replacement water in a standard manner to tank 15 each time main toilet bowl 11 is flushed. When handle 17 is pivoted downwardly, the water which is in tank 15 discharges through the channel 14 and through the channel holes into bowl 11. As a result, water 20 in bowl 11 is flushed into sewer line 12 through gooseneck trap 13.

The present invention comprises a urinal bowl 40 that is mounted by a hook-like bracket 42 to the inside wall of main toilet bowl 11 at a position proximate the front of the bowl 11. Bowl 40 is preferably composed or porcelain or other conventional toilet bowl materials similar to those comprising main bowl 11. The opened upper end of bowl 40 is positioned slightly below the upper lip of main bowl 11. It should be understood that in alternative embodiments, the urinal bowl may be permanently mounted to the main bowl 11. Such construction is illustrated in my co-pending application Ser. No. 994,354.

A PVC water inlet conduit 44 extends largely along the rim of bowl 11 and interconnects pressurized service line fitting 18 and urinal bowl 40. An outlet conduit 45 is operably connected to bowl 40 and includes a generally rigid section 46 that is formed from PVC pipe or similar material and a hose section 48 that extends below the water line and into gooseneck trap 13. Conduit 45 conducts waste that is flushed from bowl 40 in the manner described below and such waste is discharged through terminal end 50 of conduit 45 into sewer line 12.

Inlet and outlet conduits 44 and 45 are held together by a connecting rod 52. A bracket 54 joined to connector 52 and to the forward end of the urinal bowl hooks over the rim of bowl 11 so that the entire urinal assembly is mounted securely to the main bowl. In alternative embodiments, the urinal assembly may employ a structure analogous to that illustrated in FIG. 8 of my co-pending patent application Ser. No. 994,354.

A valve assembly 56 controls the flow of water under service pressure through inlet conduit 44 from line 16 to the urinal bowl 40. As best shown in FIG. 2, valve assembly 56 includes a valve housing 58 having an inlet port 60 and an outlet port 62. Inlet port 60 is connected through a fitting 64 to a first segment 66 of inlet conduit 44. Similarly, outlet port 62 is communicably connected through a fitting 68 with a second segment 70 of inlet conduit 44. Housing 56 includes an upper chamber 72 containing a slidable valve element 74 and a helical compression spring 76. The valve housing further includes a lower chamber 80, in which is disposed a conventional solenoid mechanism 82. The solenoid mechanism includes an electromagnetic coil 84 and a permanent magnet piston 86 having a wide diameter portion 88 and a narrow diameter portion 90. A second helical compression spring 92 is wound about narrow portion 90 of piston 86 and extends between the central housing wall 98 that separates chambers 72 and 80 and an upper shoulder of wide diameter piston portion 88. The upper end of piston portion 90 extends into a central opening 100 formed through housing wall 98.

Coil 82 is selectively activated by a solid state timer 102 that is connected to coil 82 via electrical leads 104 and 106. Under normal conditions, when electromagnetic coil 82 is deactivated, magnetic piston 86 is urged downwardly by springs 76 and 92 into the lowermost position in the solenoid, which position is illustrated in FIG. 2. Coil spring 76 likewise urges valve element 74 downwardly within chamber 72 such that the central channel 75 in element 74 is not aligned with the channels through conduit segments 66 and 70. As a result, valve element 74 is closed to block the passage of water through inlet conduit 44 in the direction of arrows 110. Water under service line pressure is delivered instead through line 16 (FIG. 1) into tank 15 only, so that the main bowl 11 of the toilet can be flushed when required.

After the urinal bowl 40 is used, that bowl can be flushed independently of bowl 11 by activating solid state timer 102. A timer button 112 is pressed so that for a predetermined time of, for example 3–10 seconds, a signal is provided over lines 104 and 106 (FIG. 2) to coil 82. This causes the coil to energize during that time period. Activation of the coil drawing magnetic piston 86 upwardly so that the piston is centered in coil 82. Piston 86 compresses spring 92 and narrow diameter portion 90 slides through opening 100 and bears against valve element 74. The valve element is driven upwardly against spring 76 until central channel 75 is aligned with openings 60 and 62 in housing 58. This aligns the valve element with segments 66 and 70 of inlet conduit 44. An open passageway is thereby provided through conduit 44, between service line 16 and urinal bowl 40. As a result, water under service pressure is conducted through the inlet conduit from service line 16 to the urinal bowl. This water flushes the bowl and is discharged through outlet conduit 45, which directs the liquid waste and flushing water into sewer line 12. The details of this flushing operation are described more fully in my co-pending application Ser. No. 994,354.

When the predetermined time period dictated by solid state timer 102 has elapsed, coil 84 is de-energized and spring 92 again urges piston 86 into the position shown in FIG. 2. As a result, spring 76 again urges valve element 74 into a closed condition and water is blocked from entering urinal bowl 40 through inlet conduit 44.

In alternative embodiments, solid state timer 102 may be replaced by various types of conventional switches, which can operated in a known manner to activate solenoid 82 and thereby control flushing of the urinal bowl. The flushing operation may be performed for a predetermined time period or for as long as the switch is held manually closed.

The placement of switch assembly 56 beneath the toilet tank greatly facilitates flushing of the urinal bowl with water under service pressure. Repairs can be performed relatively quickly and easily without requiting work to be done within the toilet tank. Additionally, a simpler, conventional toilet handle may be used.

Although specific features of the invention are shown in some drawings and not others, this is for convenience only, as each feature may be combined with any or all of the other features in accordance with the invention. Other embodiments will occur to those skilled in the art and are within the following claims.

What is claimed is:

1. A urinal assembly for use in a toilet apparatus having a toilet bowl, a tank communicably connected to and located generally above said bowl, a supply conduit for delivering water under service line pressure to said tank and a sewer line connected to said toilet bowl for discharging the contents of said bowl when said bowl is flushed, said urinal assembly comprising:

a urinal bowl for mounting within said toilet bowl;

an inlet conduit interconnected between said supply conduit and said urinal bowl;

a valve mechanism operably interconnected to said inlet conduit in a fixed position entirely below the bottom of said tank for controlling the flow of water under service line pressure through said inlet conduit;

an electrically activated solenoid that selectively opens said valve to introduce water under service line pressure into said urinal bowl to flush said urinal bowl and closes said valve to block the flow of water into said urinal bowl;

a solid state timer mounted permanently on a wall adjacent said toilet for directing said drive means to hold said valve open for a predetermined time period; and a discharge conduit interconnected between said bowl and said sewer line for discharging the contents of said urinal bowl when said urinal bowl is flushed.

2. The assembly of claim 1 further including bracket means for releasably mounting said urinal bowl to said main toilet bowl.

3. The assembly of claim 1 in which said inlet conduit includes first and second segments that are operably interconnected by said valve mechanism, said valve mechanism including a valve housing, a valve element movably mounted in said valve housing and having formed therethrough channel means that are communicably alignable with said first and second segments of said inlet conduit, spring means for biasing said valve element into a closed condition within said housing such that said channel is not aligned with said first and second segments, said drive means including means for selectively urging said valve element against said spring means to align said channel means with said first and second segments and open said valve mechanism.

* * * * *